US007631444B1

(12) United States Patent
Hursen

(10) Patent No.: US 7,631,444 B1
(45) Date of Patent: Dec. 15, 2009

(54) METHOD AND APPARATUS FOR PNEUMATIC EXCAVATION

(76) Inventor: Thomas Francis Hursen, 1880 Red Coach Rd., Allison Park, PA (US) 15101

( * ) Notice: Subject to any disclaimer, the term of this patent is extended or adjusted under 35 U.S.C. 154(b) by 204 days.

(21) Appl. No.: 11/745,793

(22) Filed: May 8, 2007

Related U.S. Application Data

(60) Provisional application No. 60/845,821, filed on Sep. 19, 2006.

(51) Int. Cl.
*E02F 3/88* (2006.01)

(52) U.S. Cl. ..... 37/322

(58) Field of Classification Search ..... 37/32, 37/323, 330, 331, 344, 335, 905, 322, 309–317; 175/67, 213, 215, 424; 171/16
See application file for complete search history.

(56) References Cited

U.S. PATENT DOCUMENTS 4,776,731 A 10/1988 Briggs et al.
4,936,031 A 6/1990 Briggs et al.
4,991,321 A 2/1991 Artzberger
5,140,759 A 8/1992 Artzberger
5,212,891 A 5/1993 Schuermann et al.
5,361,855 A 11/1994 Schuermann et al.
5,860,232 A * 1/1999 Nathenson et al. ..... 37/466
2004/0128866 A1 7/2004 Nathenson

* cited by examiner

*Primary Examiner*—Robert E Pezzuto
(74) *Attorney, Agent, or Firm*—Beck & Thomas, P.C.

(57) ABSTRACT

Material is pneumatically excavated and removed by discharging air under pressure from an excavation nozzle at supersonic speeds in a forward direction for excavating the material, and simultaneously discharging air under pressure from an evacuation nozzle also at supersonic speeds in a rearward direction at an adjacent position rearward of the point of forward discharge for assisting the removal of the excavated material in a rearward direction. The evacuation nozzle is in the form of a continuous annular air stream that is maintained concentric with the excavation nozzle. The nozzles are sized to provide maximum excavation and removal efficiency in co-relation to the PSI and the CFM output capabilities of the selected air source and the nozzles are positioned sufficiently close to each other whereby dynamic flow coupling is established between the nozzles such that material digging and removal performance and efficiency are maximized.

14 Claims, 5 Drawing Sheets

METHOD AND APPARATUS FOR PNEUMATIC EXCAVATION

CROSS REFERENCE TO RELATED APPLICATION

This application claims the benefit of Provisional Application No. 60/845,821, filed Sep. 19, 2006, entitled "SAFE, SUPERSONIC AIR, HORIZONTAL EXCAVATOR", which is hereby incorporated by reference in its entirety.

BACKGROUND OF THE INVENTION

This invention relates generally to excavation of soil, and more particularly to pneumatic excavation.

Tools for locating and uncovering buried utilities and other buried objects, such as tree roots etc., safely and effectively, using supersonic air jets powered by commercial air compressors, and using one or more supersonic excavation nozzles, have been used in recent years. Supersonic is defined as any speed over the speed of sound (Mach1), which is approximately 761 mph. Also, air tools for vacuuming the soil from the excavation site, such soil having been previously crumbled by a supersonic air digger or other means, have also been in common use. Some of these pneumatic excavation tools are handheld for manipulation by an individual user or users. In other instances the tools are very large and heavy and must therefore be mounted on a vehicle such as a truck or tractor, which also carries the air pressure source for the digging and usually a separate mechanical source for the vacuum evacuation.

Two such prior art structures are illustrated in U.S. Pat. Nos. 5,212,891 and 5,361,855, which use a single air source with two valve controls, one valve to control the supersonic air digging or excavation nozzle, and a second valve to control a non-supersonic air nozzle to assist in evacuation of the crumbled material. Prior art reference U.S. Pat. No. 4,991,321, utilizes a single air source under the control of a single valve to supply air under pressure to the supersonic excavation nozzle, and, in parallel, a second non-supersonic nozzle with a second control valve to carry excavate out of the excavation.

A fourth prior art reference, U.S. Pat. No. 5,140,759, uses a single air source under the control of a single valve to supply non-supersonic air excavation nozzles, and, in parallel thereto, non-supersonic nozzles to vacuum excavate out of the excavation. The innovation of this prior art reference relates to the use of a manual valve of multiple positions that supplies the two nozzle sets with air in various degrees, alternatively or simultaneously in variable amounts.

There still exists a great need for new, unique pneumatic excavation devices of better performance and greater capabilities, particularly for tunneling in differing applications and degrees of difficulty and for excavating under pavements, such as sidewalks, driveways and roads.

SUMMARY OF THE INVENTION

The present invention provides an improved, safe, lightweight, functionally optimized and economical supersonic excavator. The pneumatic excavator of the present invention provides the combination of one supersonic air digging or excavation nozzle and one vacuuming or evacuation nozzle which is also supersonic and is mechanically and dynamically coupled, and concentric with, and tandemly mounted about the same center line as the excavating nozzle. The pneumatic excavating tool of the present invention is supplied from a single plenum and powered by a single air source for safe tunneling, horizontal or vertical. Another feature of the present invention is that the portion of the air supplied under pressure to the apparatus, and which is actually in the excavation tunnel, is entirely contained within the basic diameter of the tunnel being bored, and/or within any tubular structure that is installed in the tunnel to prevent tunnel collapse as the tunnel is bored, so as to avoid the problem of engaging external structure, such as tree roots or underground cables, etc. This eliminates the requirement of excessive force to push the apparatus through the soil, thus avoiding the risk of damage to underground cables, etc.

More specifically, the present invention provides a method of pneumatically digging and removing soil by discharging air under pressure from an excavation nozzle at supersonic speeds in a forward direction for excavation of the material, and simultaneously discharging air under pressure from an evacuation nozzle at supersonic speeds in a rearward direction at an adjacent position rearward of the point of forward discharge for thereby assisting in the removal of the excavated material in a rearward direction. The rearward discharging of air under pressure through the evacuation nozzle is accomplished in the form of a continuous annular stream. This rearward annular air stream is maintained concentric with the excavation nozzle.

The air under pressure supplied through the nozzles is supplied from a single source or compressor and the nozzles, both the excavation and evacuation nozzle, are sized to provide maximum excavation and removal efficiency in co-relation to the PSI and the CFM output capabilities of the selected source.

While excavation of the tunnel is in progress, conduit may be concentrically inserted into the tunnel or excavation made as the excavation project progresses in order to simultaneously lay a conduit or pipeline, which may later be left or removed.

It also preferable that the rearward facing supersonic evacuation nozzle be positioned sufficiently close to the forward facing excavating nozzle whereby dynamic flow coupling is established between the two nozzles. This creates a maximum material evacuation vacuum within the excavation thereby maximizing overall excavation and removal performance and efficiency of the excavator.

Another feature of the excavation device of the present invention is that the evacuation nozzle may be provided with an annular inner discharge surface and a concentric annular outer discharge surface spaced from the inner discharge surface, and wherein the inner discharge surface extends rearwardly beyond the rearward termination of the outer discharge surface. This arrangement eliminates the requirement for precise axial positioning of the annular exhaust portion of the excavation nozzle relative to the inner contours of the supersonic evacuation nozzle.

In another embodiment of the present invention, an annular shroud tube is concentrically secured over the nozzle housing. In this situation a conduit may also be concentrically positioned over the delivery tube for the device as the excavation is progressing. The conduit is provided with the same external diameter and contours as this shroud. In this manner, the conduit is being laid as the excavation progresses. This delivery tube may be flexible or rigid depending upon application of the excavation device by centralizing the nozzle housing within the shroud, and thus in the following conduit, the net thrust of the nozzle housing from it's jets is also centered within the apparatus. This provides a net forward thrust of the nozzles, without any force moment that might tend to urge the tunneling apparatus to stray from an intended horizontal path. However, it is apparent that other radial positions within the shroud are also feasible, in applications where it is desirable to increase the opening to the shroud to accommodate larger stones or rocks, particularly during vertical tunneling. In addition, it is also preferable that the nozzles and nozzle housing are made of abrasive erosion resistant material for long life.

The excavation nozzle and the evacuation nozzle are supplied from a single plenum supplied with air under pressure from a single source of air under pressure, and a single valve is provided for regulating the flow of air under pressure from the source to the plenum and the nozzles.

BRIEF DESCRIPTION OF THE DRAWINGS

Other objects and advantages appear hereinafter in the following description and claims. The accompanying drawings show, for the purpose of exemplification, without limiting the scope of the invention or the appended claims, certain practical embodiments of the present invention wherein:

DETAILED DESCRIPTION OF THE PREFERRED EMBODIMENTS

Figure 1:
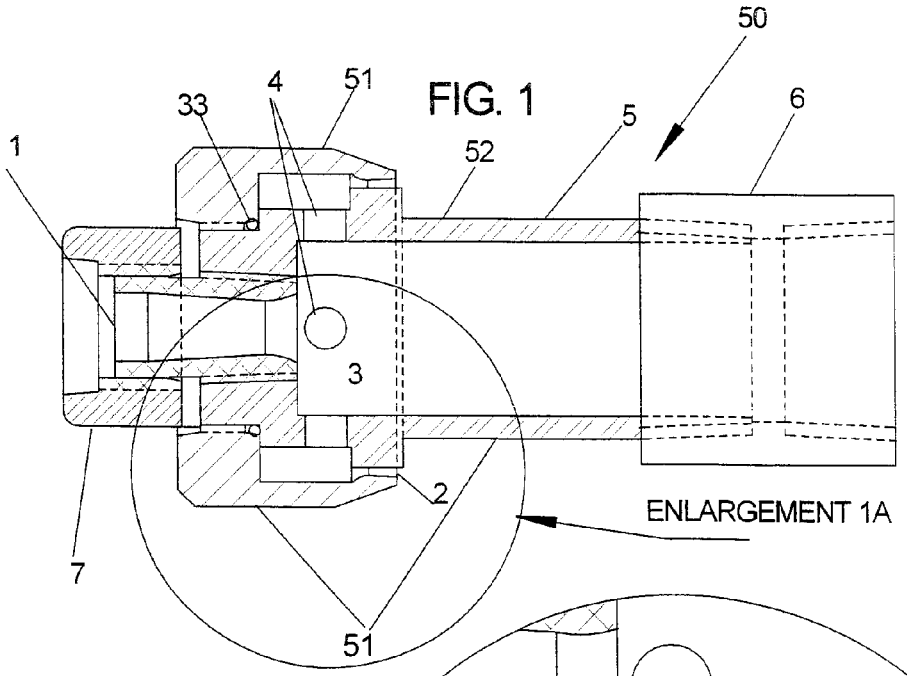
FIG. 1 is a cross sectional view of the distal end of the pneumatic excavating apparatus of the present invention.
Figure 1A:
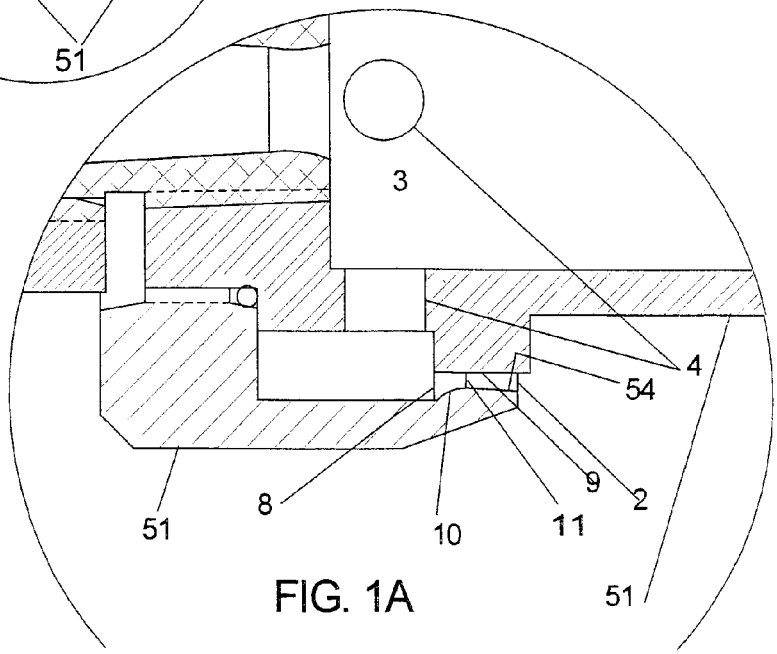
FIG. 1A is an enlarged view of the circled area of the apparatus shown in FIG. 1.
Figure 2:
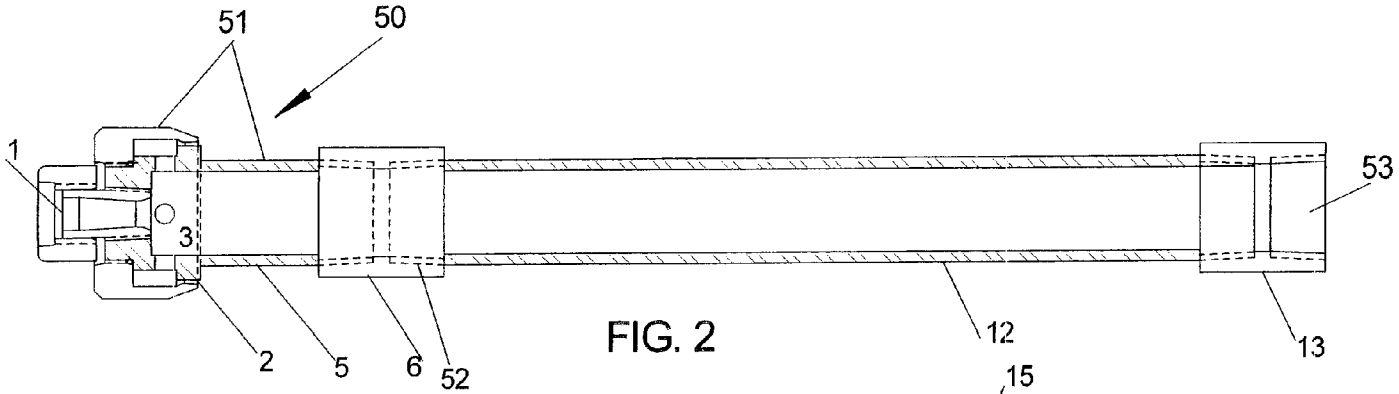
FIG. 2 is a cross sectional view of the pneumatic excavating apparatus of the present invention, including the distal end shown in FIG. 1.
Figure 2A:
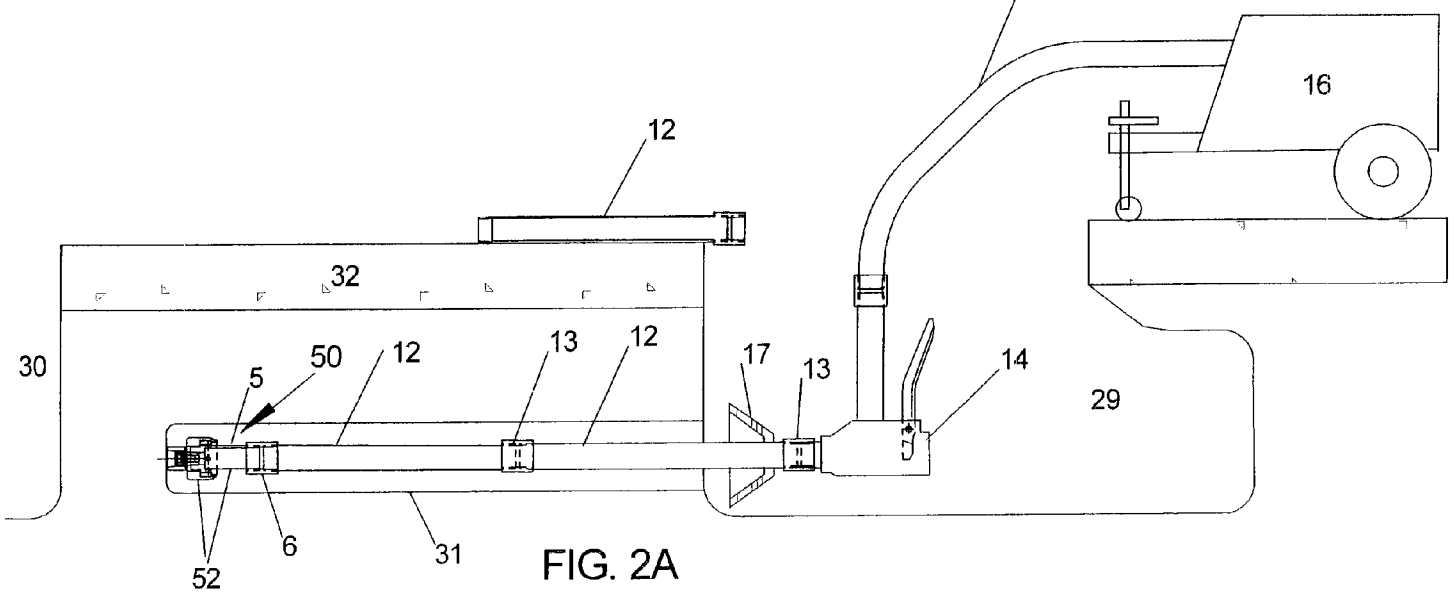
FIG. 2A is a schematic illustration of the pneumatic excavating apparatus shown in FIG. 2 in operation.

Referring to FIGS. 1 through 2A, the high pressure pneumatic device 50 of the present invention for excavating and removing material, such as earth, includes a pneumatic delivery tube comprised of rigid tube sections 5 and 12 coupled together as illustrated with couplings 6 and 13. Additional delivery tubes 12 may be added as desired and required. The pneumatic delivery tube (5, 6, 12, 13) is provided with a rearward proximal inlet 53 connected to a source of air under pressure in the form of air compressor 16 via flexible hose coupling 15 and single lever valve 14.

A nozzle housing 51 is provided on the distal outlet end 52 and is provided with a forwardly directed excavation nozzle 1 contoured and dimensioned for delivery of air under pressure therethrough at supersonic speeds for digging material or earth in front of it as illustrated in FIG. 2A. The nozzle housing 51 includes a rearwardly directed evacuation nozzle 2 also connected to the air under pressure supplied from compressor 16 to the common plenum 3. Evacuation nozzle 2 is positioned for projecting the air under pressure therefrom rearwardly over the delivery tube 5 to assist in removal of the excavated material. This rearwardly directed evacuation nozzle 2 is also contoured as indicated at 10 and dimensioned for delivery of air under pressure therethrough at supersonic speeds. In addition, evacuation nozzle 2 is further contoured and dimensioned to provide a continuous annular air stream, and evacuation nozzle 2 is also concentric with excavation nozzle 1. Also, the evacuation nozzle 2 has an annular inner discharge surface 9 and a concentric annular outer discharge surface 54 spaced from inner discharge surface 9. Inner discharge surface 9 extends rearwardly beyond the rearward termination of outer discharge surface 54. This configuration is provided so that the flat cylindrical surface 9 does not require precise axial positioning in relation to the contoured surface 10 of evacuation nozzle 2, which creates the supersonic projection of air under pressure therefrom.

The air is supplied to the common plenum 3 and is supplied to evacuation nozzle 2 via the ports 4 in plenum 3. Supersonic nozzle 1 is directly connected to plenum 3. In order that the air under pressure be ejected from nozzles 1 and 2 at supersonic speeds, the contours of the nozzles not only have to be contoured as shown to provide supersonic projection, but, of course, the air pressure within plenum 3 must also be beyond a predetermined minimum. In addition, the excavation and evacuation nozzles 1 and 2 are sized to provide maximum excavation and removal efficiency in co-relation to the PSI and the CFM output capabilities of the selected source of air under pressure supplied by compressor 16. Also, the nozzles 1 and 2 are positioned sufficiently close to each other whereby dynamic flow coupling is established between the nozzles such that material digging or excavation and removal performance and efficiency of the device 50 are maximized. Also, the nozzle tip 7 for excavation nozzle 1 and the housing 51 are constructed of abrasive erosion resistant material in order to give them a maximum life. The tip 7 is also replaceable, as is the outer casing for housing 51, which is sealed to the remainder of the housing 51 by means of O-ring 33 to prevent leakage.

The forward excavating supersonic air nozzle 1 produces a supersonic jet that crumbles the dirt. About a foot forward of this nozzle exit it loses sufficient energy that it can no longer dig and the jet is reflected from the solid earth, reverses direction and carries the crumbled dirt back towards the apparatus, conveying the excavate through the tunnel cavity previously excavated. This reverse flowing air from the digging excavation nozzle 1 is drawn or accelerated by the vacuum inducement produced by the supersonic air excavating nozzle 2, by means of the lower than atmospheric local pressure in the exit air stream of the vacuum inducing supersonic air evacuating nozzle 2, in accordance with the Bernoulli principal. Since the vacuum inducement from supersonic air evacuation nozzle 2 is supersonic and designed to maximize conversion of the available pressure supply from compressor 16, the maximum exit velocity is obtained. This generates the maximum local pressure drop (again the Bernoulli principal) achievable from the compressor with a single nozzle. Thus the rate and size of the pieces of dirt and stone that can be removed is increased in size and thereby maximizing or optimizing evacuation and overall performance. When the two nozzle 1 and 2 are in close tandem, and the evacuation nozzle is supersonic, the reversed air from the excavating nozzle 1 is most readily drawn towards the exit of the evacuation nozzle 2. As the combined air streams exit the tunnel being excavated, it carries with it the loose material that has been excavated or crumbled. The cross sectional area available for exit flow is determined by the total mass flow rate of air.

The evacuation nozzle 2 is constructed of two separate elements to form single, concentric, supersonic velocity producing shaped nozzle, which is converging, then expanding. Air under pressure is supplied to the nozzle entrance 8, the air passing through a constricting throat 11, then through an expansion to its exit in the form of an annular stream. This nozzle is formed by a flat cylindrical surface 9 and a contoured surface 10. The constricting throat 11 is formed appropriately by the relative distance between the two surfaces, locally, at an appropriate location between the flow nozzle entrance 8 and its exit. The exit end of the surface 9 is extended beyond the termination of the surface 54, as previously explained.

The purpose of the housing 51 structure is to minimize the outside diameter of the apparatus, which minimizes the structure impeding the passage of crumbled dirt from the excavation. It also serves the purpose of uniformly distributing the vacuum inducing region around the operating circumference of the housing. Otherwise, multiple nozzles are required to produce a series of local vacuums around the circumference of the apparatus, but at the cost of an apparatus that is larger in diameter, more expensive and less effective. By making one surface of the evacuation nozzle, a flat cylindrical surface 9 that actually extends beyond the nozzle exit, and the other surface with the required contour 10 and exit surface 54, the manufacturing thereof is simpler and the axial positioning of the two surfaces is less exacting.

In FIGS. 2 and 2A, rigid conduit sections 12 are added and connected with rigid couplings 13. The total length of the various conduit pieces 12 are sufficient length to bore the desired length of tunnel and the rigid pipe sections also simultaneously provide a means of manually directing and placing the nozzle housing 51 in correct position for boring or excavating. This configuration is readily suitable for tunnels of at least 20 feet in length, the conduit material usually being of light weight aluminum. In each figure, a coupling is illustrated between the nozzle assembly and the trailing pressure passage, as a convenience. Alternatively, the coupling could be avoided by connecting the trailing pressure passage directly to the rear of the nozzle assembly, and adjusting the radial support accordingly.

In FIG. 2 the complete system of the present invention is illustrated and tunneling is started in starting pit 29 and continued to ending pit 30. A single control valve 14 is rigidly connected by the second coupling 13 to the assembly for ease of handling the entire excavating assembly. The control valve 14 in turn is coupled to a second flexible hose 15, which is coupled at its opposite end to air compressor 16. Two of the rigid conduits 12 are already secured and positioned in the tunnel 31 with another rigid conduit 12 lying on the pavement 32, ready to be added when required. A dirt shield 17, flexible or rigid, is slidably mounted on the proximal end 53 of the nearest rigid conduit section 12 where it is connected by coupling 13 to control valve 14. This protects the operator from excavated debris.

Figures 3, 3A:
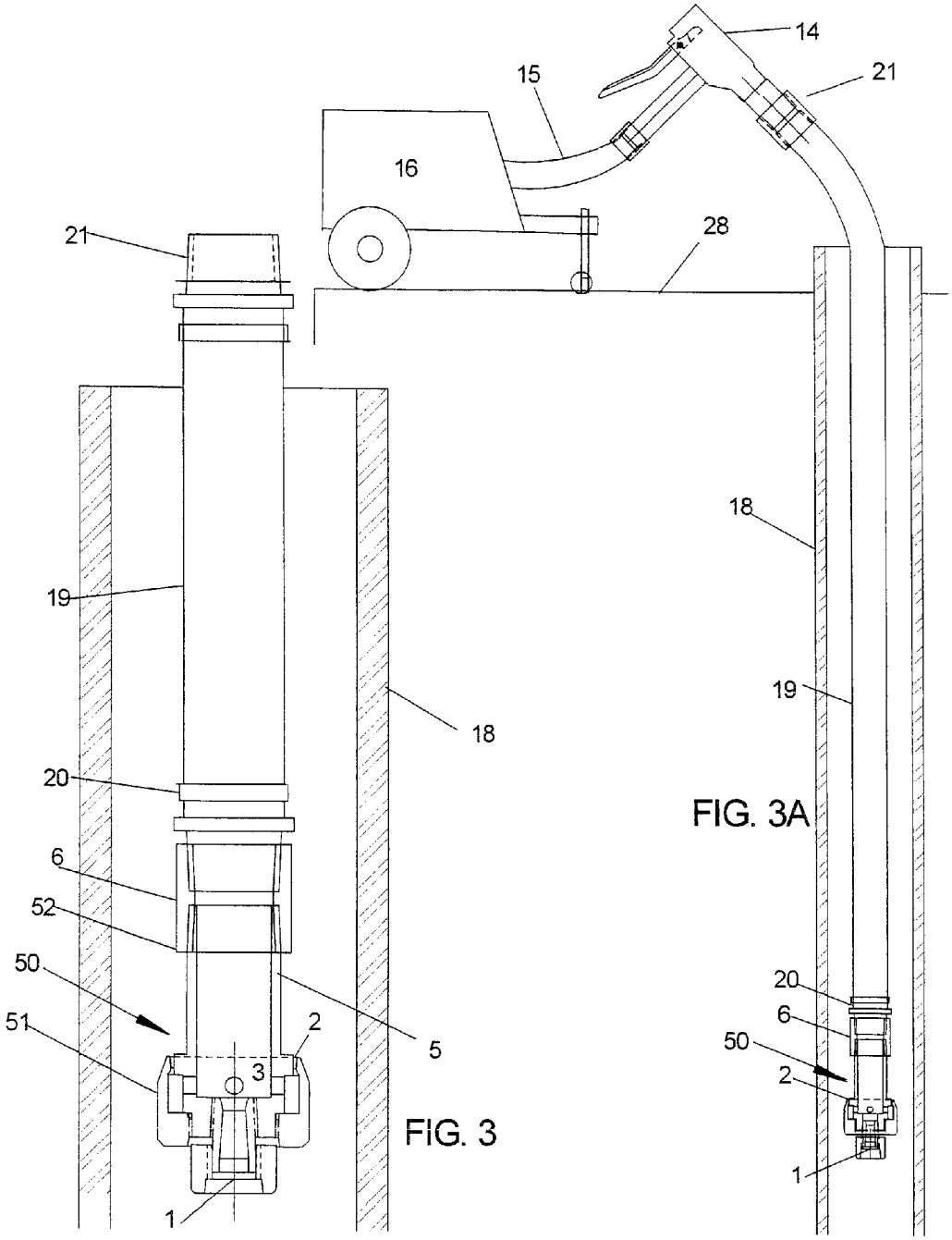
FIG. 3 illustrates the pneumatic excavation apparatus of FIG. 2 being used in a vertical application for clearing a surrounding conduit or pipe shown in cross section.
FIG. 3A is a schematic illustration of the apparatus shown in FIG. 3 in use.

Referring next to the embodiment shown in FIGS. 3 and 3A, an alternative embodiment to the apparatus of FIG. 2 is shown. In this illustration it is intended to clean out a horizontal or vertical pipe 18 containing dirt or other debris that must be removed. In this instance, the nozzle housing 51 is supplied with air by a flexible air hose 19 instead of the rigid conduit shown in FIGS. 1 and 2. The hose 19 is at least of a length required to clear the obstruction in the pipe 18. The distal or forward end 20 of hose 19 is coupled to the forward rigid pipe section 5 by means of coupling 6. The rearward proximal end of the hose 19 is coupled by coupling 21 to valve 14.

Because of the small diameter of the housing 51, it may be pushed into or dropped into the pipe 18 to be excavated along with its attached flexible hose 19, which is sufficiently stiff, particularly when it is pressurized, to assist in forcing the housing 51 downwardly into the pipe 18. When the nozzles 1 and 2 are operating, they tend to balance the thrust of each other. Although both nozzles operate from the same pressure source, compressor 16, they produce a net forward or downward moving force, because a greater mass flow rate is assigned to the vacuum nozzle. The net, open cross sectional area within the vertical pipe 18 is thereby cleared. The vertical pipe 18 inside diameter, less the flexible hose 19 outside diameter area, determines the total mass air flow required to transport the excavate out of the vertical pipe 18 being cleared.

Figure 4:
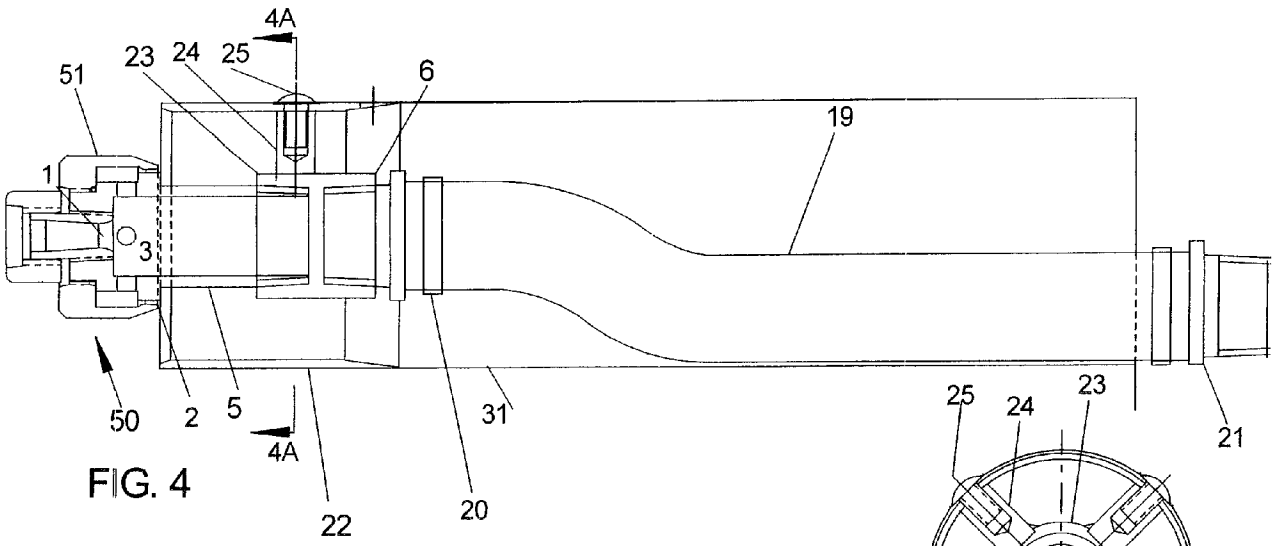
FIG. 4 shows another embodiment of the pneumatic excavating apparatus shown in FIG. 2 with a flexible supply conduit as opposed to the rigid supply conduit shown in FIG. 2 and further being illustrated in combination with the distal end thereof being shown in cross section and including an annular shroud tube concentrically secured over the nozzle housing.
Figure 4A:
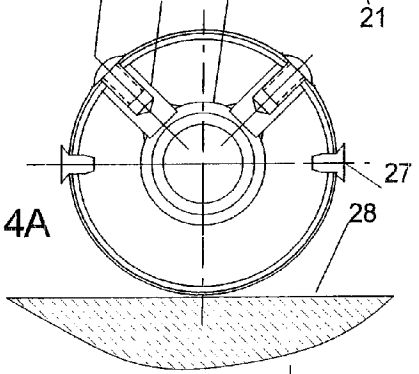
FIG. 4A is a view in vertical cross section of the apparatus shown in FIG. 4 as seen along section line 4A-4A.
Figure 4B:
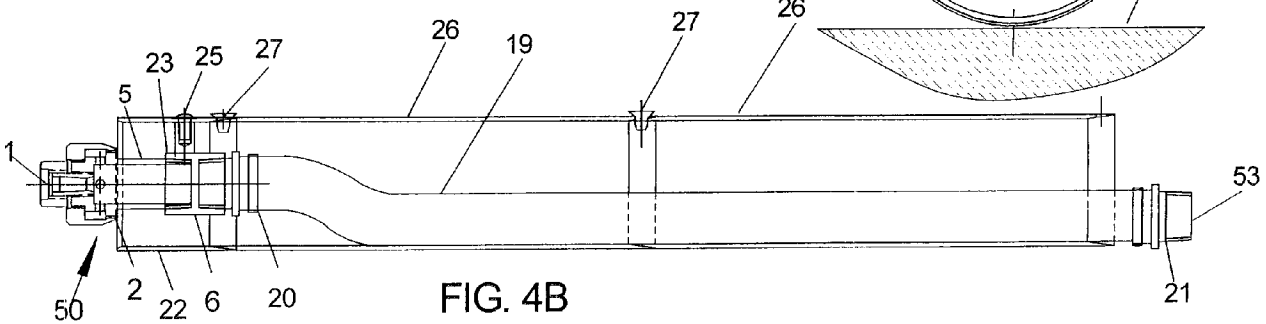
FIG. 4B illustrates the pneumatic excavating apparatus of FIG. 4 in combination with the concentric insertion of conduit into an excavation made by the apparatus of FIG. 4 in order to permanently lay conduit as the excavation progresses.
Figure 4C:
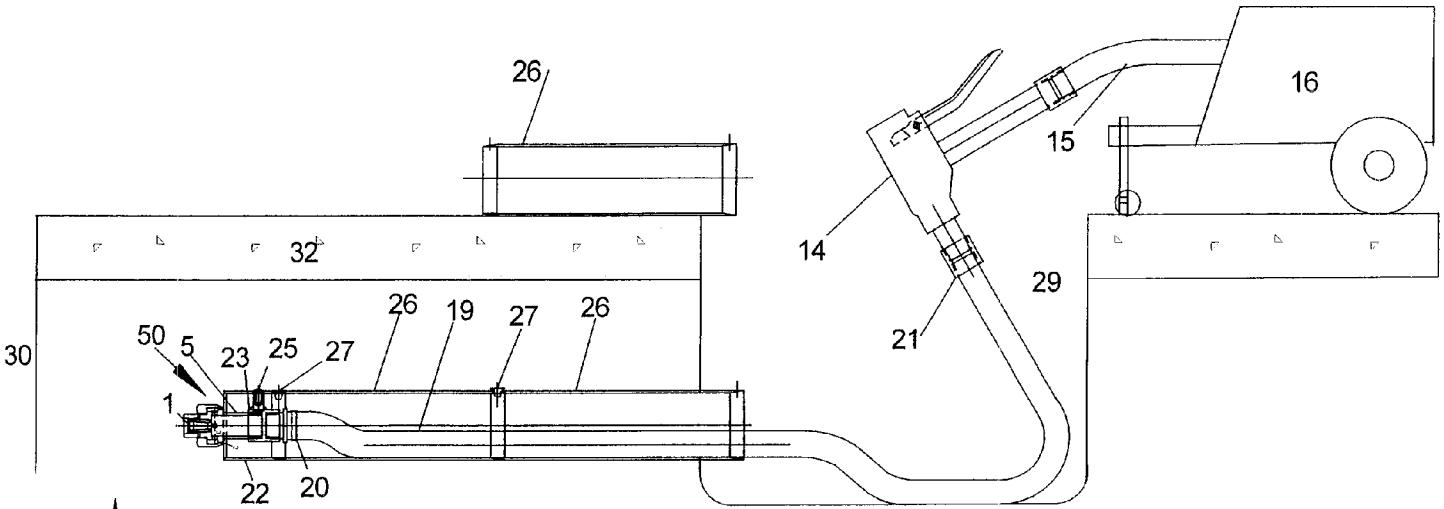
FIG. 4C is a schematic illustration of the apparatus shown in FIG. 4A in operation.

Referring next to the embodiment of FIGS. 4A through 4C, the apparatus of the present invention is shown to illustrate the method of the present invention for digging longer tunnels. Similar elements are provided with the same character reference numerals. The flexible air hose 19 is provided in sufficient length required to dig the tunnel. An additional short concentric shroud tube 22 surrounds the nozzle head 51 to provide a means of centralizing the nozzle apparatus within the tunnel 21 being excavated. This is particularly helpful for long tunnels where the digging head will be very remote from the operator. The relative position of this short concentric shroud tube 22 is established by suitable radial support structure, comprised of third rigid coupling 23, struts 24 and screws 25, at two mutually perpendicular circumferential locations. A single radial support may be substituted if it is sufficiently rigid. The material being excavated will flow inside this short shroud tube 22, being drawn there by the vacuum created by the rearward facing vacuum inducing supersonic evacuation nozzle 2.

A second tubular structure 26 attaches behind the excavating head of the housing 51 in stages as the digging proceeds. Each subsequent second tubular structure 26 attaches to the prior section to form a continuous tube which is used to push the head 51 forward as the tunnel progresses. It also protects the tunnel from collapse and may, optionally, be left in place after completion of the tunnel to protect the tunnels final contents, such as fiber optic cable, etc. The connection between each second tubular structure 26 and the short concentric shroud tube 22 may be accomplished by means of two friction pins 27 for each joint, being placed in each overlapping joint or by other means.

In FIG. 4C two of the second tubular structures 26 are in the tunnel with another second tubular structure 26 lying on the pavement 32, ready for use to be added to the others, if required. As the tunnel 31 is bored, additional sections of the second tubular structure 26 can be added by closing the control valve 14, opening the hose end 21, and sliding the additional second tubular structure 26 over the first flexible hose 19, inserting the next two friction pins 27, reconnecting the air supply and proceeding as before.

Figure 5:
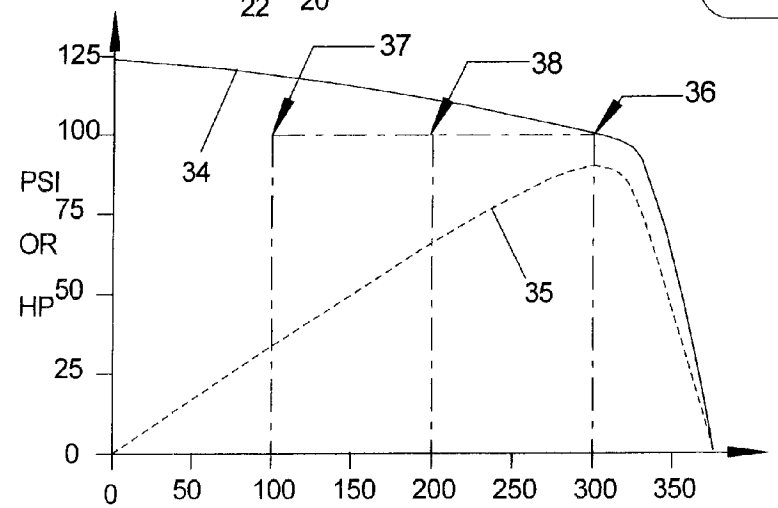
FIG. 5 is a graphical illustration of the general shape of a typical compressor performance curve showing output PSI as a function of output flow, CFM.

The graphical illustration of FIG. 5 serves to assist in describing how the method of the present invention is used to optimized the total performance of the apparatus and then, within that optimization, the separate optimization of the performance of the two operating functions, digging and excavating. The solid line is the performance curve 34 of this particular compressor and is the typical shape of a diesel powered portable air compressor 16. The PSI is the output pressure in pounds for square inch as a function of CFM output, or cubic feet per minute at standard conditions. By following the steps indicated hereinafter, the nozzles are sized to provide maximum excavation and removal efficiency in co-relation to the PSI and the CFM output capabilities of the selected source or compressor 16.

As a first step, one determines the operating point at the maximum output power of the compressor for the complete apparatus. Then the compressor output power over the operating range is calculated for discrete points along the performance curve 34 using the appropriate thermodynamic equations. These resulting points are plotted at convenient scale as a function of CFM. This result is the power curve 35 in FIG. 5. The optimum operating point for the total apparatus at the peak power output available, is selected from this power curve 35. For this compressor, at 300 CFM, which corresponds to point 36 on the performance curve, this point 36 corresponds to a pressure of 100 PSI.

The second step is to recognize that both nozzles receive air from the same plenum and they both operate at the same source pressure, but potentially at different flow rates (CFM). Therefore, both nozzles must operate at 100 PSI in this instance, or as a particular matter, at 90 PSI to allow for the pressure drop in the hose and other pressure losses between the compressor 16 and the two nozzles 1 and 2 of the apparatus.

Next, one selects an operating flow for the excavation nozzle 1, since, if the device does not dig, or dig well, there will not be much crumbled material to excavate. For most soils, other than those that are heavily compacted and have zero moisture content, they can be dug (dirt crumbled) with a supersonic jet produced from a source of 90 PSI and 100 CFM.

Accordingly, 200 CFM remains for the sizing of the vacuum inducing supersonic evacuation nozzle 2 (300−100=200). Therefore, its operating point becomes 90 PSI and 200 CFM. This appropriately devotes twice as much energy to the excavating function as to the digging function. This avoids assigning more energy than required for digging, and assigns as much as possible to the excavating function, which also increases the maximum transit distance.

The two operating points, thus selected, are identified as 37 and 38 on FIG. 5 for the apparatus considered.

I claim:

1. The method of pneumatically excavating and removing material, comprising:

supplying air under pressure to a common plenum;

discharging air under pressure from the common plenum through an excavation nozzle at supersonic speeds in a forward direction for excavating the material, and simultaneously discharging air under pressure in a continuous annular air stream from the common plenum through an evacuation nozzle at supersonic speeds in a rearward direction at an adjacent and rearward position of the common plenum for assisting in the removal of said excavated material in a rearward direction said supply of air under pressure, common plenum, excavation nozzle, evacuation nozzle all arranged as an axially contiguous structure on a shared centerline.

2. The method of claim 1, wherein the rearward annular air stream is maintained concentric with said excavation nozzle.

3. The method of claim 1, wherein said nozzles are sized to provide maximum excavation and removal efficiency in correlation to the CFM output capabilities of the selected source.

4. The method of claim 1, including concentrically inserting conduit into an excavation made by said forward discharge of air as the excavation progresses.

5. The method of claim 1, including positioning said evacuation nozzle sufficiently close to said excavating nozzle whereby dynamic flow coupling is established between the two nozzles, thereby maximizing overall excavation and evacuation performance and efficiency.

6. A supersonic pneumatic device for simultaneously excavating and evacuating material, comprising:

a pneumatic delivery tube having a rearward proximal inlet for connection to a source of air under pressure and a forward distal outlet connected to a common plenum provided in a nozzle housing;

the nozzle housing having a forwardly directed excavation nozzle contoured and dimensioned for delivery of said air under pressure therethrough at supersonic speeds for excavating the material;

said nozzle housing including a rearwardly directed evacuation nozzle connected to said common plenum, and positioned for projecting said air under pressure therefrom rearwardly over said delivery tube to assist in removal of the excavated material;

said rearwardly directed evacuation nozzle contoured and dimensioned for delivery of said air under pressure therethrough at supersonic speeds.

7. The supersonic pneumatic device of claim 6, wherein said evacuation nozzle is further contoured and dimensioned to provide a continuous annular air stream.

8. The supersonic pneumatic device of claim 7, wherein said evacuation nozzle is concentric with said excavation nozzle.

9. The supersonic pneumatic device of claim 6, wherein said nozzles are sized to provide maximum excavation and evacuation efficiency in correlation to the CFM output capabilities of the selected source of air under pressure.

10. The supersonic pneumatic device of claim 6, including conduit positioned over said delivery tube.

11. The supersonic pneumatic device of claim 10, including an annular shroud tube concentrically secured over said nozzle housing.

12. The supersonic pneumatic device of claim 11, wherein said shroud tube has the same external diameter and contours as said conduit.

13. The supersonic pneumatic device of claim 6, wherein said nozzles are positioned sufficiently close to each other whereby dynamic flow coupling is established between said nozzles such that material excavation and removal performance and efficiency are maximized.

14. A supersonic pneumatic device for evacuating material, comprising:

a pneumatic delivery tube having a rearward proximal inlet for connection to a source of air under pressure and a forward distal outlet connected to a plenum provided in a nozzle housing;

the nozzle housing having a rearwardly directed evacuation nozzle connected to said plenum and positioned for projecting said air under pressure therefrom rearwardly over said delivery tube;

said evacuation nozzle contoured and dimensioned for delivery of said air under pressure therethrough at supersonic speeds and therefrom in a continuous annular stream.

* * * * *

UNITED STATES PATENT AND TRADEMARK OFFICE

CERTIFICATE OF CORRECTION

PATENT NO. : 7,631,444 B1
APPLICATION NO. : 11/745793
DATED : December 15, 2009
INVENTOR(S) : Thomas Francis Hursen It is certified that error appears in the above-identified patent and that said Letters Patent is hereby corrected as shown below:

Column 2, Line 37 cancel "It also" and insert --It is also--

Column 2, Line 64 cancel "from it's jets" and insert --from its jets--

Column 5, Line 2 cancel "nozzle" and insert --nozzles-- (1st occurrence)

Column 5, Line 9 cancel "form single" and insert --form a single--

Column 6, Line 31 cancel "comprised of third rigid" and insert --comprised of rigid--

Column 6, Line 60 cancel "optimized" and insert --optimize--

Signed and Sealed this

Twentieth Day of April, 2010

David J. Kappos

David J. Kappos
*Director of the United States Patent and Trademark Office*